US007234424B2

(12) United States Patent
Tanaka et al.

(10) Patent No.: US 7,234,424 B2
(45) Date of Patent: Jun. 26, 2007

(54) VARIABLE STROKE-CHARACTERISTIC ENGINE FOR VEHICLE

(75) Inventors: Shigekazu Tanaka, Saitama (JP); Taichi Yoshikawa, Saitama (JP); Koichi Eto, Saitama (JP); Hisashi Sato, Saitama (JP); Akinori Maezuru, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/311,620

(22) Filed: Dec. 20, 2005

(65) Prior Publication Data

US 2006/0144354 A1 Jul. 6, 2006

(30) Foreign Application Priority Data

Dec. 21, 2004 (JP) ..... 2004-368938

(51) Int. Cl.
*F02B 75/04* (2006.01)
*F02D 15/02* (2006.01)

(52) U.S. Cl. ..... 123/48 B; 123/78 F

(58) Field of Classification Search ..... 123/53.1–53.5, 123/192.2, 48 B, 78 F
See application file for complete search history.

(56) References Cited

U.S. PATENT DOCUMENTS

2002/0050252 A1* 5/2002 Moteki ..... 123/48 B
2002/0139324 A1* 10/2002 Moteki et al. ..... 123/48 B
2003/0019448 A1* 1/2003 Aoyama et al. ..... 123/90.16

FOREIGN PATENT DOCUMENTS

JP 10061510 A * 3/1998
JP 2003-322036 11/2003
JP 2004-156537 6/2004

* cited by examiner

*Primary Examiner*—Noah P. Kamen
(74) *Attorney, Agent, or Firm*—Arent Fox LLP

(57) ABSTRACT

In a variable stroke-characteristic engine for a vehicle, a control shaft and a control link are disposed on a front side of a vehicle body with respect to a crankshaft. An actuator for driving the control shaft is disposed on an outer surface of an engine block on the front side of the vehicle body. Thus, the actuator projects as much as possible from a position of the engine block toward the front side of the vehicle body so that traveling wind from ahead of the vehicle is effectively applied to the actuator to enhance the cooling effect. Hence, any temperature increase of the actuator is suppressed. Moreover, the actuator is disposed as far as possible from an exhaust manifold that is heated to a high temperature by the heat of an exhaust gas.

6 Claims, 9 Drawing Sheets

VARIABLE STROKE-CHARACTERISTIC ENGINE FOR VEHICLE

RELATED APPLICATION DATA

The present invention is based upon Japanese priority application No. 2004-368938, which is hereby incorporated in its entirety herein by reference.

BACKGROUND OF THE INVENTION

1. Field of the Invention

The present invention relates to a variable stroke-characteristic engine for a vehicle, including a first link connected to a piston; a second link connected to the first link and a crankshaft; a third link connected at one end to the first link or the second link and movably supported at the other end on an engine block through a control shaft; and an actuator which drives the control shaft.

2. Description of the Related Art

Japanese Patent Application Laid-open Nos. 2004-156537 and 2003-322036 disclose a variable stroke-characteristic engine for a vehicle, having a crankshaft with a main journal rotatably supported in an engine block; a control shaft with a main journal supported for swinging in a predetermined angle range in the engine block; a lower link swingably supported on a pin journal of the crankshaft; an upper link connecting the lower link to a piston; and a control link connecting the lower link to a pin journal of the control shaft, wherein the compression ratio is modified by changing the phase of the control shaft through an actuator to alter the positions of a top dead center and a bottom dead center of the piston.

As described in Japanese Patent Application Laid-open No. 2004-156537, where the actuator connected to an end of the control shaft is disposed on an outer surface of the engine block, if the actuator is located at an exhaust-side portion of the engine block, the high temperature of an exhaust manifold is known to be capable of affecting the durability of the actuator.

Further, as described in Japanese Patent Application Laid-open No. 2003-322036, if the actuator is accommodated on a bottom of the engine block, the influence of the heat from an exhaust gas is avoided. However, in such an arrangement, it is impossible to apply traveling wind to the actuator, which results in a reduction in an amount of heat that is dissipated. Also, the temperature of the actuator is known to rise, which affects the durability of the actuator.

SUMMARY OF THE INVENTION

Accordingly, it is an aspect of the present invention to enhance the cooling effect provided to an actuator which drives a control shaft of a variable stroke-characteristic engine.

In order to achieve the above aspect, according to a first feature of the present invention, there is provided a variable stroke-characteristic engine for a vehicle. The engine includes a first link connected to a piston; a second link connected to the first link and a crankshaft; a third link connected at one end to the first link or the second link and movably supported at the other end on an engine block through a control shaft; and an actuator for driving the control shaft. The third link and the control shaft are disposed on a front side of a vehicle body with respect to the crankshaft. The actuator is connected to an end of the control shaft and is disposed on an outer surface of the engine block on the front side of the vehicle body.

With the arrangement of the first feature, the control shaft and the third link are disposed on a front side of a vehicle body with respect to the crankshaft. Also, the actuator is disposed on an outer surface of the engine block on the front side of the vehicle body. Thus, the actuator projects as much as possible from a position of the engine block toward the front side of the vehicle body and is exposed on the outer surface of the engine block. Thus, traveling wind is effectively applied to the actuator and enhances the cooling effect thereof, wherein the increase in temperature of the actuator is suppressed to improve the durability of the actuator.

According to a second feature of the present invention, the third link, the control shaft and the actuator are disposed on a side opposite from an exhaust manifold with respect to the crankshaft.

With the arrangement of the second feature, the actuator is disposed as far as possible from the exhaust manifold, which is heated due to the relatively high temperature of the heat provided by an exhaust gas, wherein the increase in temperature of the actuator is suppressed to improve the durability of the actuator, and the retention of an oil film on the sliding portions of the third link and control shaft is improved.

According to a third feature of the present invention, wherein a hydraulic pressure supply device, which supplies a working oil to the actuator, is disposed on a front portion of the vehicle body opposed to the actuator, the actuator is spaced apart from the engine block.

With the arrangement of the third feature, it is possible to prevent the vibration of the engine and the heat of the engine from reaching the hydraulic pressure supply device, which improves the reliability and durability of the actuator.

According to a fourth feature of the present invention, one end of the actuator is disposed at an axial end of the crankshaft and the other end is disposed on a front end side of the engine block. Also, a switch valve, which supplies the working oil from the hydraulic pressure supply device to the actuator, is disposed on a front surface of the engine block and at an end of the engine block that is closer to the actuator.

With the arrangement of the fourth feature, an increase in size of the engine in a widthwise direction of the vehicle is avoided compared to a case where a switch valve is integrally provided with an actuator. Moreover, a distance between the actuator and the switch valve is reduced which prevents any reduction in operational responsiveness of the actuator.

According to a fifth feature of the present invention, the actuator is disposed at a portion of the engine block on the front side of the vehicle body, and a portion of the engine block closer to the cylinder head is inclined rearwards of the vehicle body.

With the arrangement of the fifth feature, traveling wind is effectively applied to the actuator disposed at the portion of the engine block located on the front side of the vehicle body, and the traveling wind applied to the actuator smoothly escapes in a rearward direction. Moreover, it is possible to prevent the heat from residing in the upper portion of the actuator which further improves the cooling effect of the wind on the actuator.

An upper link 22 of a below-discussed embodiment corresponds to the first link of the present invention. A lower link 18 of a below-discussed embodiment corresponds to the second link of the present invention. A control link 28 of a below-discussed embodiment corresponds to the third link of the present invention.

The above and other aspects, features and advantages of the invention will become apparent from the following description of the preferred embodiment taken in conjunction with the accompanying drawings.

DETAILED DESCRIPTION OF PREFERRED EMBODIMENT

A preferred embodiment of the present invention will be described with reference to the accompanying drawings.

Figure 1:
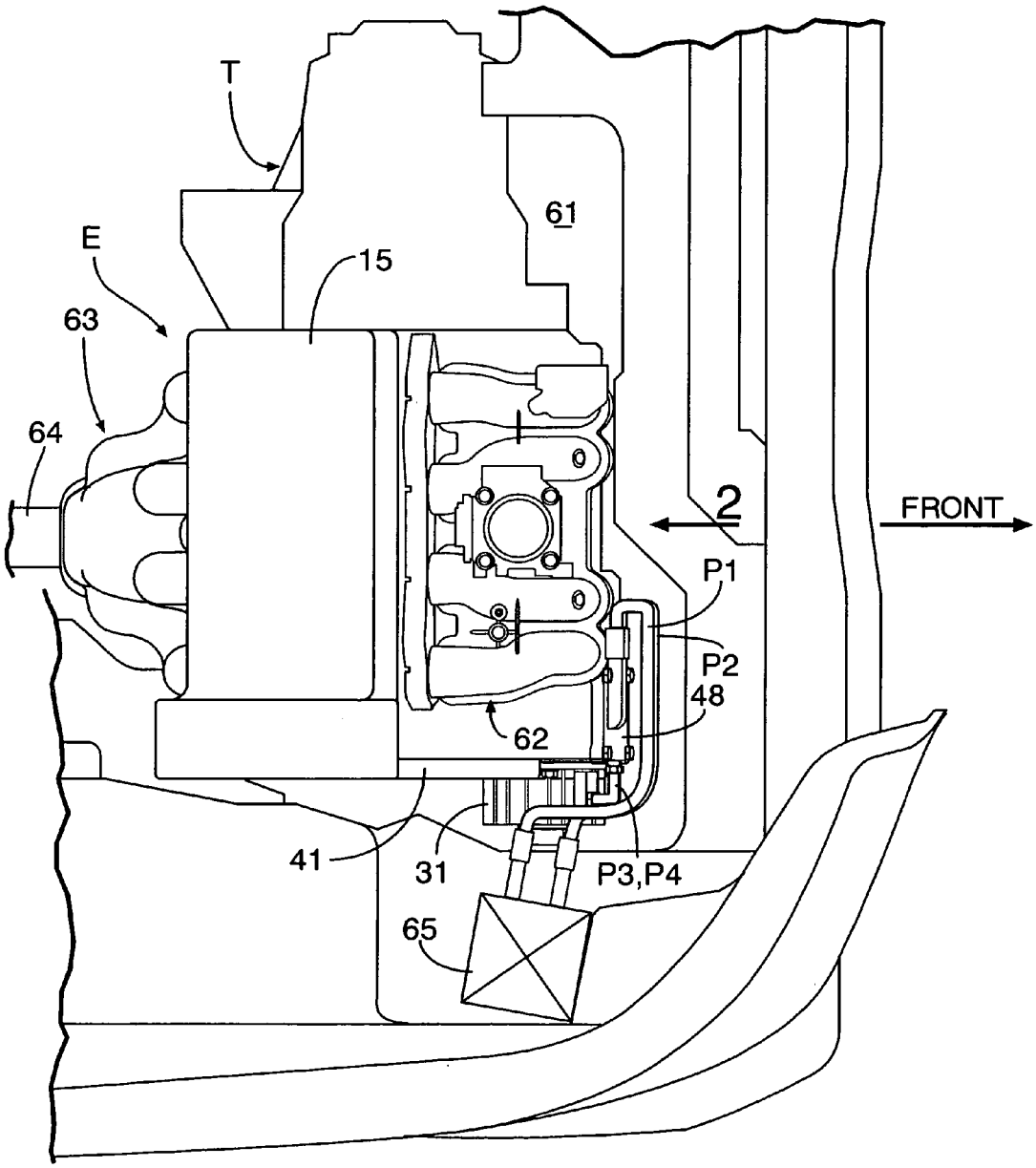
FIG. 1 is a plan view of an engine room of a vehicle according to a preferred embodiment of the present invention.
Figure 2:
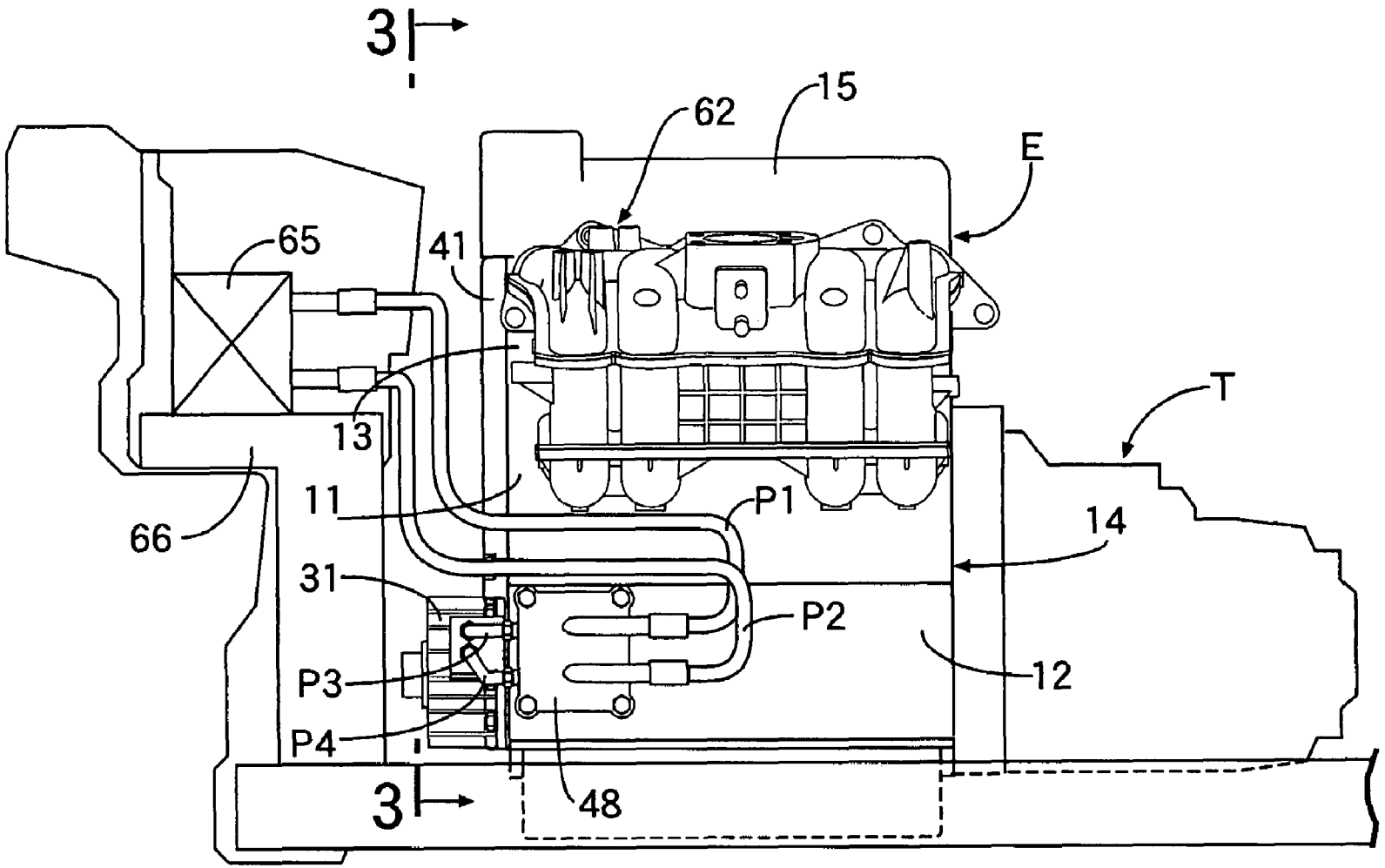
FIG. 2 is a side view of the engine room shown in FIG. 1 that is taken in a direction of arrow 2.
Figure 3:
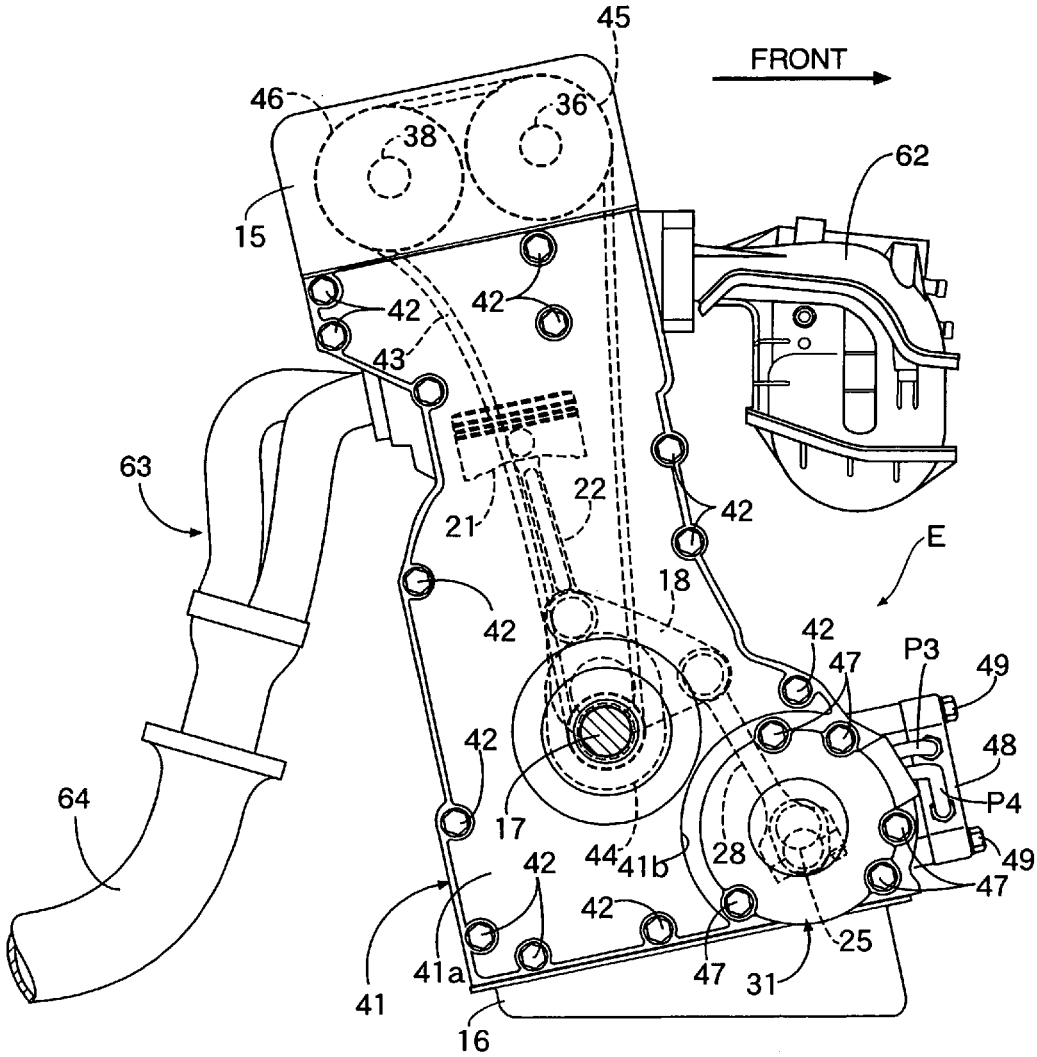
FIG. 3 is a side view of the engine room shown in FIG. 1 that is taken along line 3—3 of FIG. 2.

As shown in FIGS. 1 to 3, a variable compression-ratio engine E, which is one example of a variable stroke-characteristic engine wherein the position of a top dead center or a bottom dead center of a piston is changeable, is mounted at a sideward position in an engine room 61 in a front portion of a vehicle body of an automobile. A transmission T is coupled to a left side of the engine E. The engine E includes an engine block 14 to which a cylinder block 11, a crankcase 12 and a cylinder head 13 are coupled. A head cover 15 is coupled to an upper portion of the cylinder head 13. An oil pan 16 is coupled to a lower portion of the crankcase 12. The engine E is mounted in a rearward-inclining state, wherein an upper portion that is closer to the head cover 15 is located on a rear side of the vehicle body relative to a lower portion that is closer to the oil pan 16. An intake manifold 62 is coupled to a front surface of the cylinder head 13 on a front side of the vehicle body. An exhaust manifold 63 and an exhaust pipe 64 are coupled to a rear surface of the cylinder head 14 on a rear side of the vehicle body.

A chain cover 41 is detachably fixed, by a plurality of bolts 42, to one end face of the engine block 14 having the cylinder block 11, the crankcase 12 and the cylinder head 13. A timing chain 43, disposed in a space between the engine block 14 and the chain cover 41, is reeved around a driving sprocket 44 that is mounted at an end of a crankshaft 17. Follower sprockets 45 and 46, respectively, are mounted at ends of an intake camshaft 36 and an exhaust camshaft 38.

The chain cover 41 includes a cover body 41*a* covering the timing chain 43, and a plate-shaped mounting seat 41*b* having an intake-side end that is depressed toward the crankcase 12. An actuator 31 is fitted to the mounting seat 41*b*, wherein the actuator 31 and mounting seat 41*b* are together secured to the crankcase 12 by a plurality of, e.g., five in the illustrated embodiment, bolts 47. The mounting seat 41*b* has a thin plate-shape and is in close contact with an end face of the crankcase 12 wherein there is no space therebetween. Also, the bolts 47 pass through a seat, formed around an outer periphery of the actuator 31 as well as the mounting seat 41*b* of the chain cover 41, and threadedly engage an end face of the crankcase 12. A valve block 48, which controls operation of the actuator 31, is fixed by a plurality of bolts 49 to a front surface of the crankcase 12 adjacent to the actuator 31.

As is apparent from FIGS. 4 to 7, a main journal 17*a* of the crankshaft 17 is rotatably supported on mating faces of the cylinder block 11 and the crankcase 12. Also, a substantially triangular lower link 18 is swingably supported at an intermediate portion thereof onto a pin journal 17*b* that is eccentric relative to the main journal 17*a*. A piston 21 is slidably received in a cylinder sleeve 20 mounted in the cylinder block 11. An upper link 22, i.e., a connecting rod, is pivotally supported at an upper end thereof by the piston 21 through a piston rod 23, and is pivotally supported at a lower end by one end of the lower link 18 through a first pin 24.

A main journal 25*a* of a crank-shaped control shaft 25 is swingably supported by a cap 27 that is fastened to the crankcase 12 by bolts 26, 26 on a lower surface of the crankcase 12 at locations that are laterally eccentric from a position of the crankshaft 17. A control link 28 includes a body 28*a* and a cap portion 28*b* fastened by bolts 29, 29 to a lower end of the body 28*a*. The body 28*a* is pivotally supported at an upper end by another end of the lower link 18 through a second pin 30. A pin journal 28*b* of the control shaft 25 is pivotally supported between a lower end of the body 28*a* and the cap portion 28*b*. The control shaft 25 is swung in a predetermined angle range by a hydraulically controlled actuator 31 mounted at one end of the control shaft 25.

An intake port 32 and an exhaust port 33 open into a combustion chamber 13*a* formed in a lower surface of the cylinder head 13. An intake valve 34, which opens and closes the intake port 32, and an exhaust valve 35, which opens and closes the exhaust port 33, are mounted in the cylinder head 13. The intake valve 34 is driven to be opened and closed by an intake camshaft 36 through an intake rocker arm 37. The exhaust valve 35 is driven to be opened and closed by an exhaust camshaft 38 through an exhaust rocker arm 39.

Figure 9:
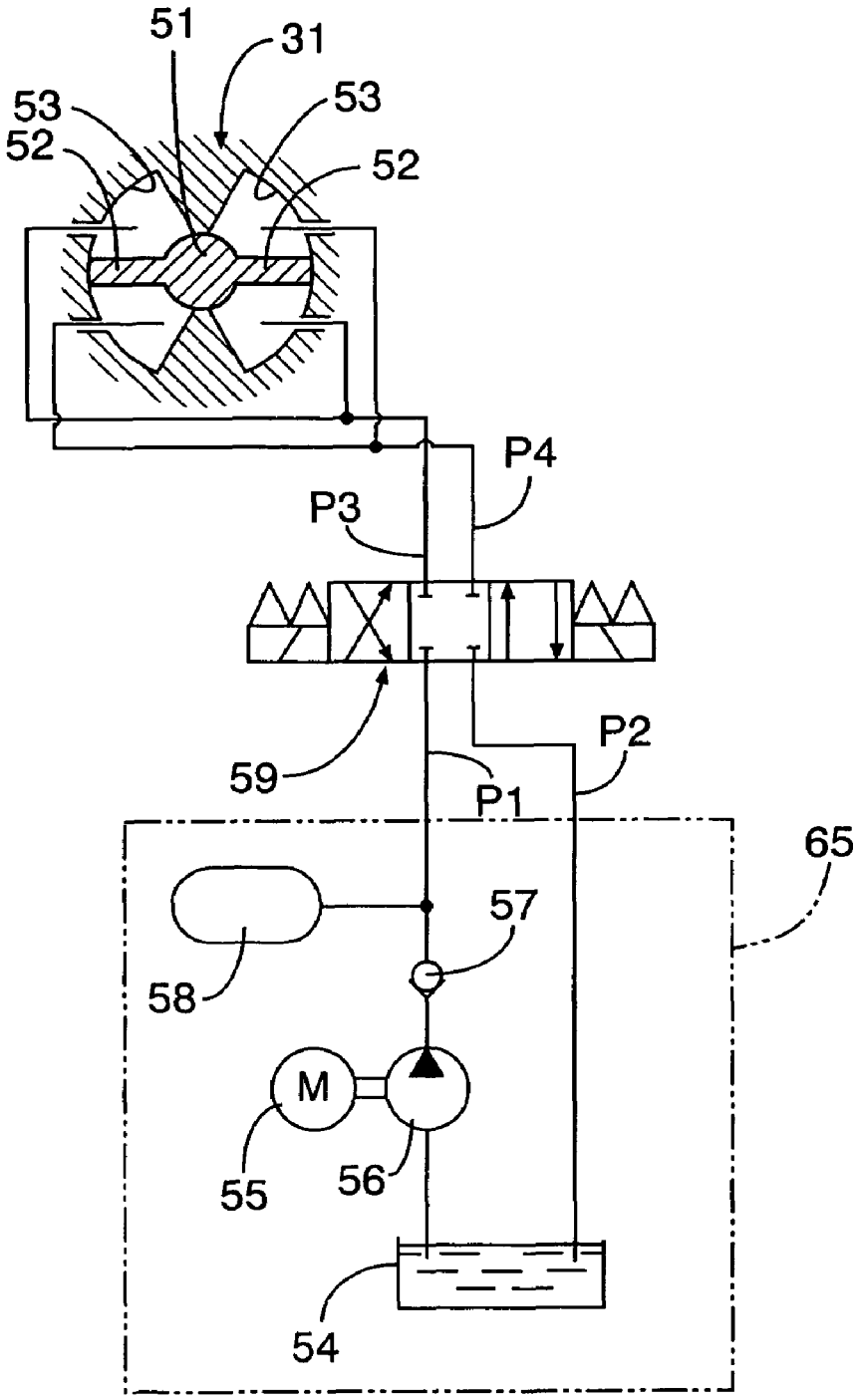
FIG. 9 is a schematic diagram of a hydraulic circuit of a control system for an actuator according to a preferred embodiment of the present invention.

As shown in FIG. 9, the actuator 31 includes fan-shaped oil chambers 53, 53 which accommodate a pair of vanes 52, 52 extending on opposite sides of a rotary shaft 51. An oil pump 56 driven by a motor 55, a check valve 57, an accumulator 58 and a switch valve 59 is disposed between an oil tank 54 and the oil chambers 53, 53. The oil tank 54, the motor 55, the oil pump 56, the check valve 57 and the accumulator 58 define a hydraulic pressure supply device 65 of the present invention. The switch valve 59 is mounted within the valve block 48. Therefore, when the switch valve 59 is switched leftward, the vanes 52, 52 are moved by a hydraulic pressure that is generated by the oil pump 56, such that the rotary shaft 51 is rotated in a counterclockwise direction. Conversely, when the switch valve 59 is switched rightward, the vanes 52, 52 are moved by a hydraulic pressure generated by the oil pump 56, such that the rotary shaft 51 is rotated in a clockwise direction. In this manner, the phase of the control shaft 25, connected to the rotary shaft 51, is changed.

As shown in FIGS. 1 and 2, a bracket 66 is mounted to stand on the right side of a front portion of the engine room 11, wherein the bracket 66 is opposed by the actuator 31 mounted on a right side of a front end of the engine room 14. The hydraulic pressure supply device 65 is supported at an upper portion of the bracket 66. The hydraulic pressure supply device 65 and the switch valve 59 are connected to each other by hydraulic pressure pipes P1 and P2. The switch valve 59 and the actuator 31 are connected to each other by hydraulic pressure pipes P3 and P4.

The operation of the present invention according to a preferred embodiment and having the above-described structural arrangement will be described below.

Figure 4:
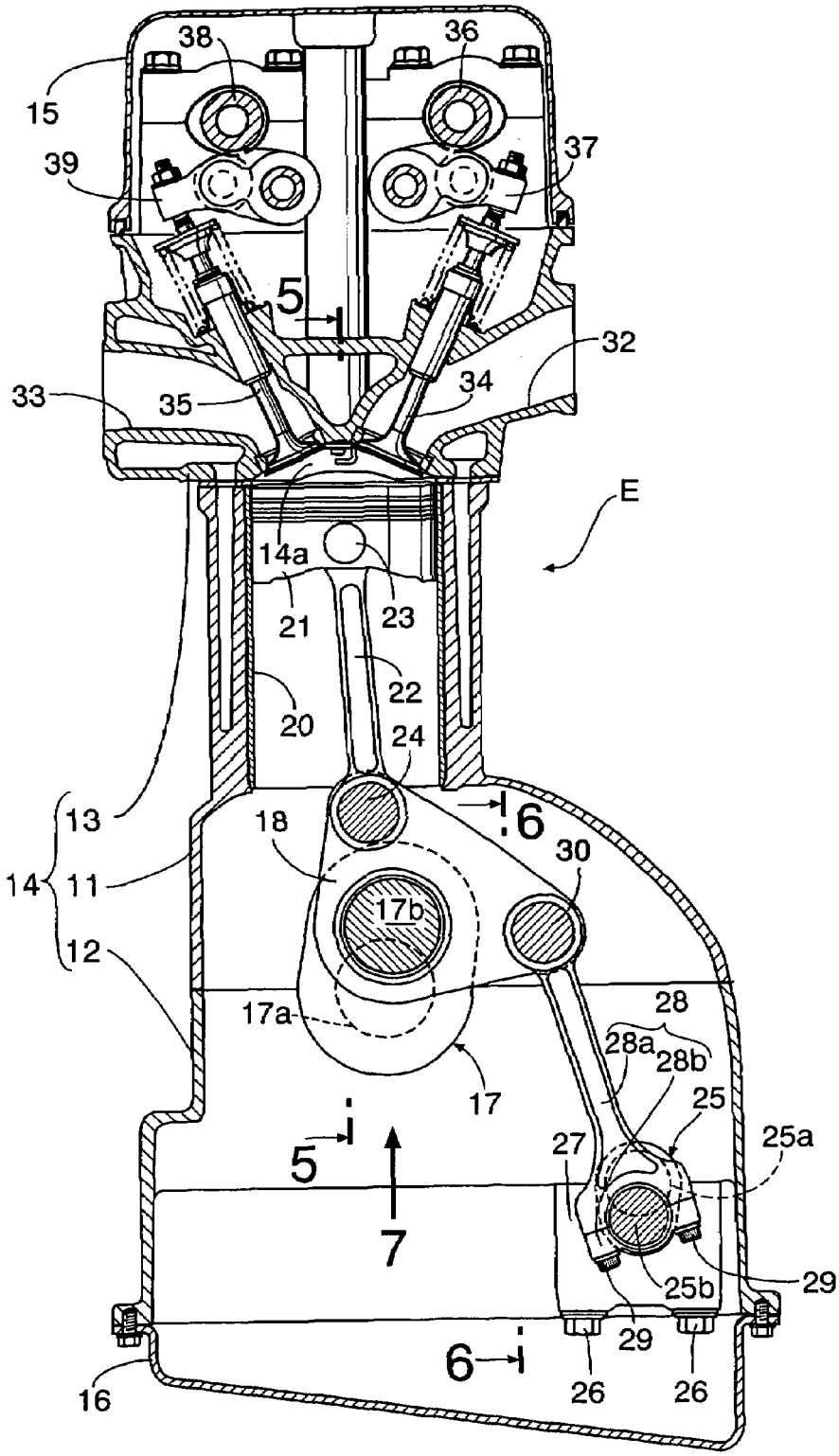
FIG. 4 is a vertical sectional view of a variable compression-ratio engine, in a high compression-ratio state, according to a preferred embodiment of the present invention.
Figure 5:
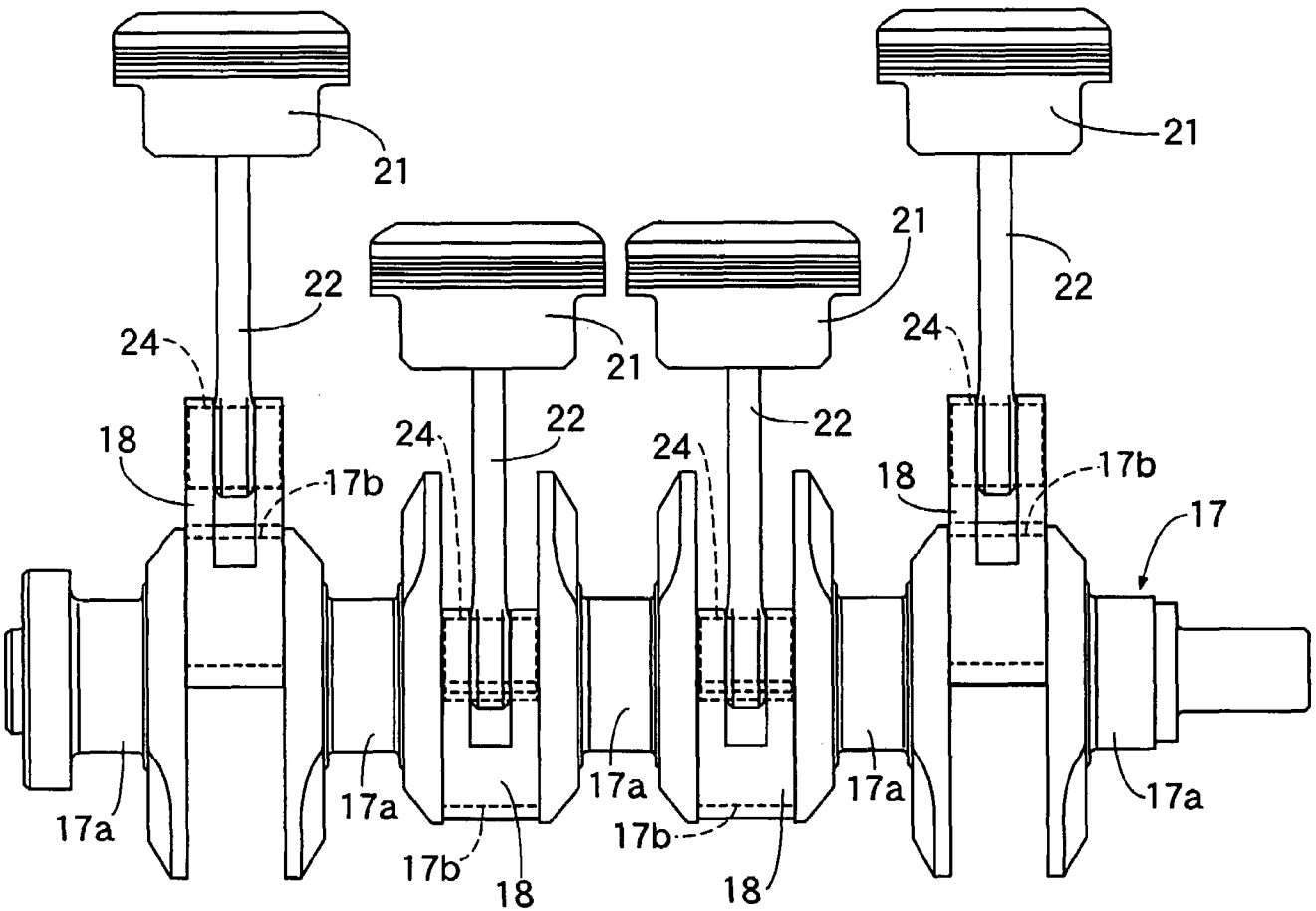
FIG. 5 is a side view of the engine shown in FIG. 4 taken along line 5—5 of FIG. 4.
Figure 6:
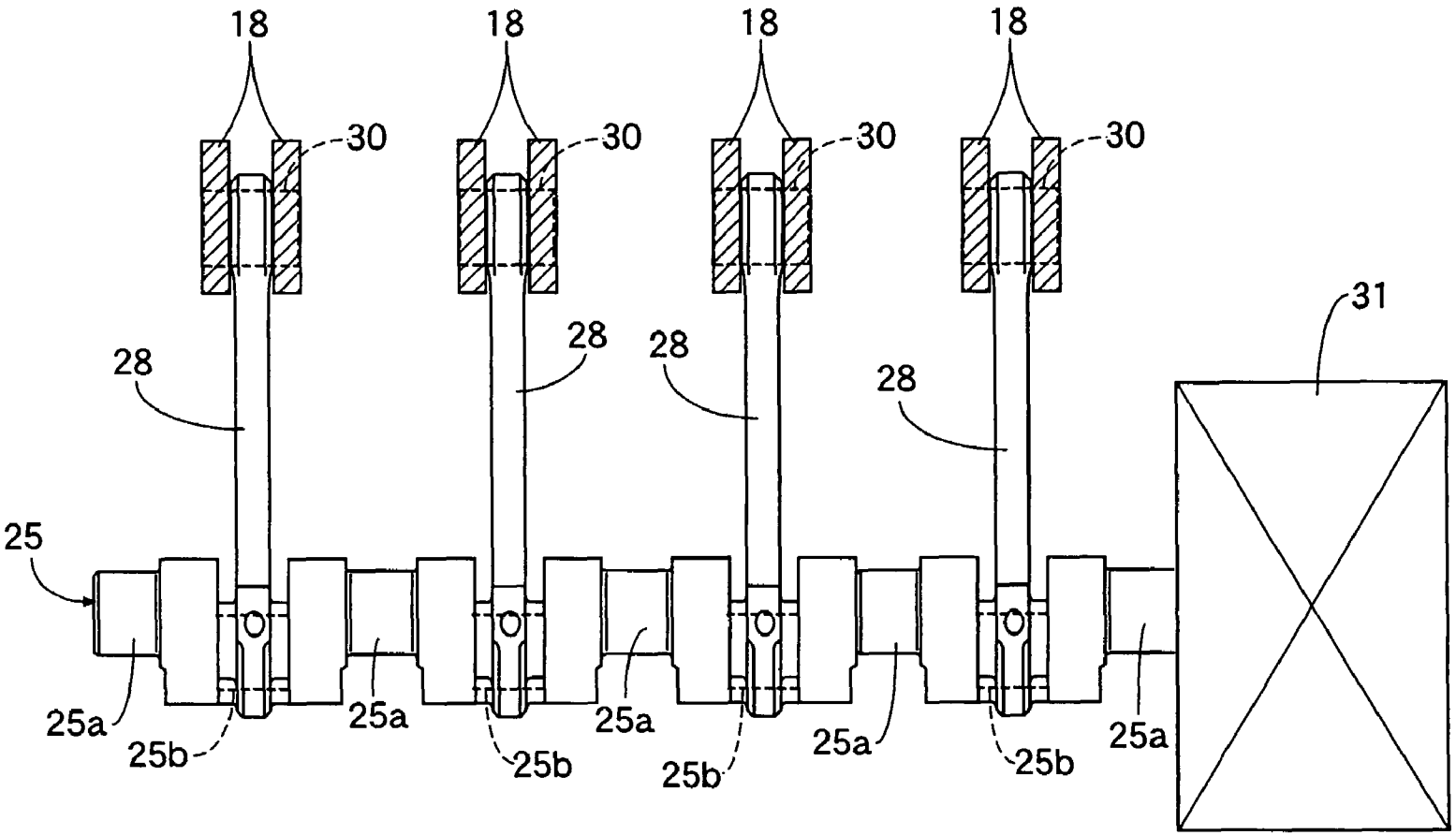
FIG. 6 is another side view of the engine shown in FIG. 4 taken along line 6—6 of FIG. 4.
Figure 7:
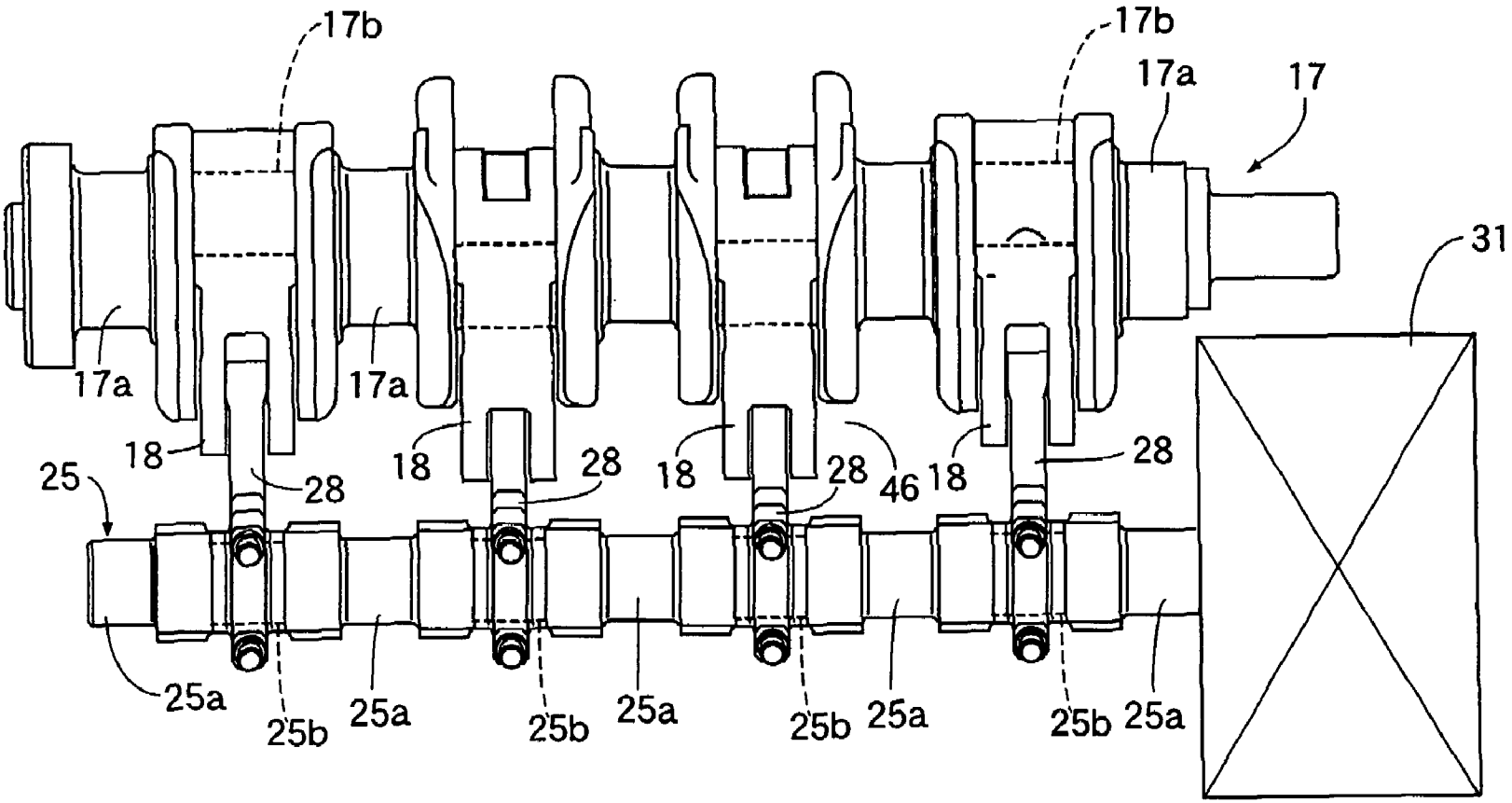
FIG. 7 is a bottom view of the engine shown in FIG. 4 taken in a direction indicated by arrow 7 of FIG. 4.
Figure 8:
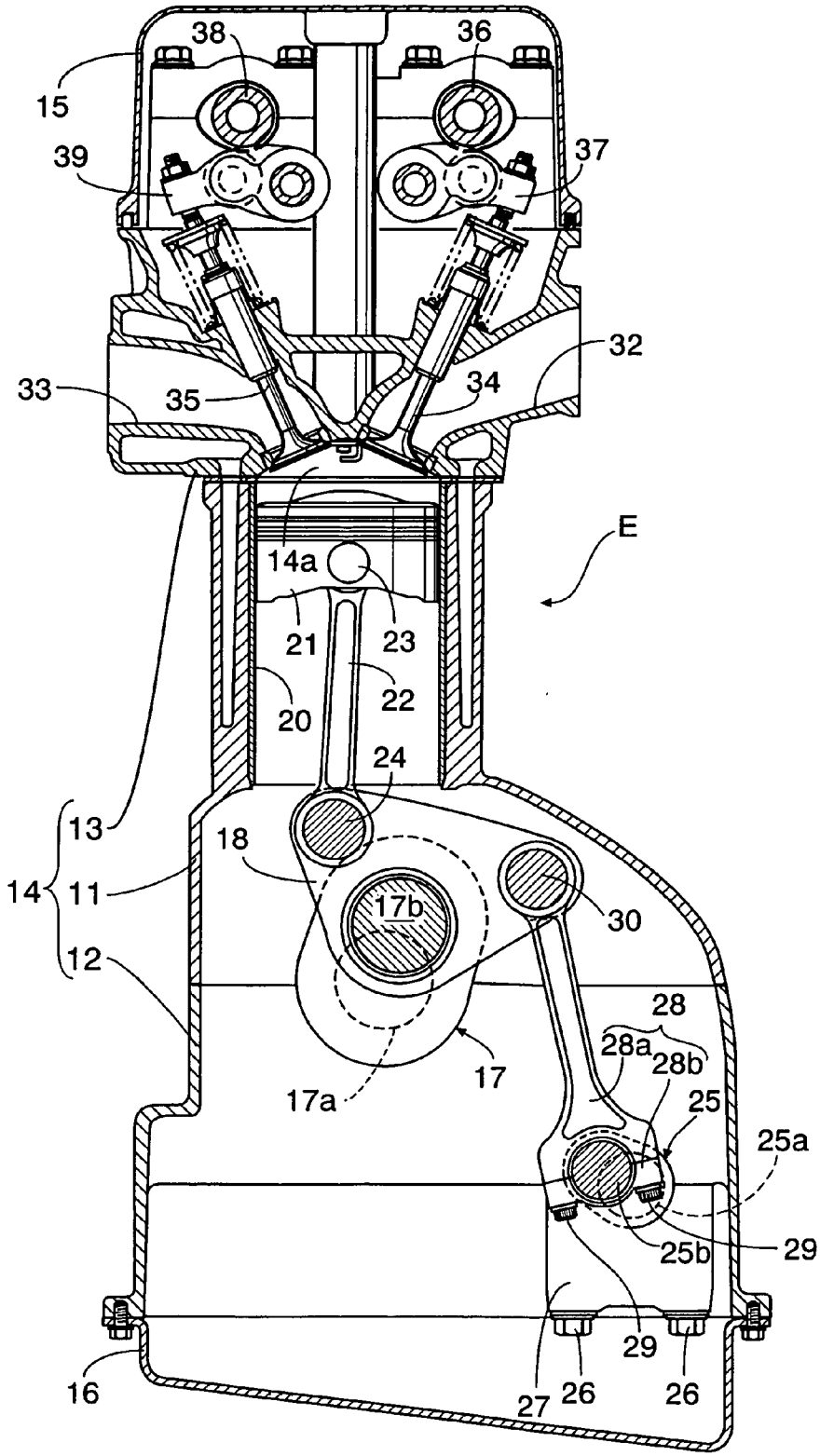
FIG. 8 is a vertical sectional view of the variable compression-ratio engine, in a low compression-ratio state, according to a preferred embodiment of the present invention.

The actuator 31 is driven in accordance with the operational state of the engine E, wherein the control shaft 25, connected to the actuator 31, is rotated to any position between a position shown in FIG. 4 and a position shown in FIG. 8. In the position shown in FIG. 4, the pin journal 25*b* is located below the main journal 25*a* of the control shaft 25, whereby the control link 28 is pulled down to swing the lower link 18 in the clockwise direction about the pin journal 17*b* of the crankshaft 17, and the upper link 22 is pushed up to raise the position of the piston 21. In this manner, the engine is brought into a high compression ratio state.

Conversely, in the position shown in FIG. 8, the pin journal 25*b* is located above the main journal 25*a* of the control shaft 25, whereby the control link 28 is pushed up to swing the lower link 18 in the counterclockwise direction about the pin journal 17*b* of the crankshaft 17, and the upper link 22 is pulled down to lower the position of the piston 21. In this manner, the engine E is brought into a low compression ratio state.

As described above, the control link 28 is vertically moved by the swinging of the control shaft 25, and the motion-limiting condition of the lower link 18 is modified to change the stroke characteristic, including the top dead center position of the piston 21, wherein the compression ratio of the engine E is controlled to any desired degree.

Thus, in the present invention, according to the preferred embodiment, the control shaft 25 and the control link 28 are disposed on the front side of the vehicle body with respect to the crankshaft 17. Moreover, the actuator 31, connected to the end of the control shaft 25, is disposed on an outer surface of the engine block 14 on the front portion of the vehicle body. Thus, the actuator 31 projects as much as possible from a position of the engine block 14 toward the front side of the vehicle body and the actuator 31 is exposed on the outer surface of the engine block 14. Accordingly, any traveling wind is effectively applied to the actuator 31 to enhance the cooling effect thereof, wherein any increase in temperature of the actuator 31 is suppressed which improves the durability of the actuator 31.

Further, because the control shaft 25, the control link 28 and the actuator 31 are disposed on the side opposite from the exhaust manifold 63 with respect to the crankshaft 17, the actuator 31 is located as far as possible from the exhaust manifold 63 which is heated from the high temperature of the passing exhaust gas. Accordingly, any undesirable temperature increase of the actuator 31 is suppressed which improves the durability of the actuator 31. Also, the retention of an oil film on the main journal 25*b*, which pivotally supports the control shaft 25 and the control link 28, is improved.

Furthermore, the hydraulic pressure supply device 65 is disposed at the front portion of the vehicle body and spaced apart from the engine block 14 which is heated to a high temperature during operation of the engine. Therefore, it is possible to prevent the vibration of the engine E and the heat of the engine E from reaching the hydraulic pressure supply device 65 which improves the reliability and durability of the actuator 31. Moreover, because the actuator 31 is disposed in a widthwise direction of the vehicle to face the hydraulic pressure supply device 65, the length of the hydraulic pressure pipes P1 and P2, connecting the actuator 31 to the hydraulic pressure supply device 65, is minimized. Further, the switch valve 59 for supplying a working oil from the hydraulic pressure supply device 65 to the actuator 31, disposed on the side of the front end of the engine block 14, is provided at a location closer to the actuator 31 and at the front end of the engine block 14. Therefore, an increase in size of the engine E in the widthwise direction of the vehicle is suppressed compared to a case where a switch valve 59 is provided integrally with an actuator 31. Moreover, because the distance between the actuator 31 and the switch valve 59 is reduced, there is no reduction in the operational responsiveness of the actuator 31.

Further, the upper portion of the engine is inclined rearwards. Thus, the traveling wind entering the engine room from ahead of the vehicle body is first applied to the actuator 31, mounted at the front end of the engine block 14, which improves the cooling effect. Also, the traveling wind applied to the actuator 31 smoothly escapes in a rearward direction, plus, it is possible to prevent the heat from residing in the upper portion of the actuator which further improves the cooling effect on the actuator.

Although the preferred embodiment of the present invention has been described above, various modifications in design may be made thereto without departing from the scope and spirit of the invention.

For example, although the variable compression-ratio engine has been described in the embodiment, it is within the scope of the present invention to structure the engine so that one or both of the compression ratio and the displacement of the engine can be changed by changing the sizes of various portions or components in a similar structure. The present invention is also applicable to these variable stroke-characteristic engines.

In addition, although in the above-described embodiment the control link 28 is connected to the lower link 18, it is within the scope of the present invention to connect the link 28 to the upper link 22.

Further, although in the above-described embodiment the valve block 48 is constructed separately from the actuator 31, it is within the scope of the present invention to integrally construct the valve block 48 and actuator 31 with each other.

What is claimed is:

1. A variable stroke-characteristic engine for a vehicle, comprising:

a first link connected to a piston;

a second link connected to the first link and a crankshaft;

a third link connected at a first end to one of the first link and the second link and movably supported at a second end on an engine block through a control shaft; and an actuator for driving the control shaft, wherein the third link and the control shaft are disposed on a front side of a vehicle body with respect to the crankshaft, wherein the actuator is connected to an end of the control shaft, and is disposed on an outer surface of the engine block on the front side of the vehicle body, and wherein a hydraulic pressure supply device for supplying a working oil to the actuator is disposed on a front portion of the vehicle body opposite to the actuator, wherein the actuator is spaced apart from the engine block.

2. The variable stroke-characteristic engine according to claim 1, wherein the actuator is disposed at an axial one end of the crankshaft and on a front end side of the engine block, and wherein a switch valve for supplying the working oil from the hydraulic pressure supply device to the actuator is disposed on a front surface of the engine block and at an end of the engine block closer to the actuator.

3. The variable stroke-characteristic engine according to claim 1, wherein the actuator is disposed at a portion of the engine block on the front side of the vehicle body, and wherein a portion of the engine block closer to a cylinder head is inclined rearward of the vehicle body.

4. A variable stroke-characteristic engine for a vehicle, comprising:

a first link connected to a piston;

a second link connected to the first link and a crankshaft;

a third link connected at a first end to one of the first link and the second link and movably supported at a second end on an engine block through a control shaft; and an actuator for driving the control shaft, wherein the third link, the control shaft and the actuator are disposed on a side opposite from an exhaust manifold with respect to the crankshaft, and wherein a hydraulic pressure supply device for supplying a working oil to the actuator is disposed on a front portion of the vehicle body opposite to the actuator, wherein the actuator is spaced apart from the engine block.

5. The variable stroke-characteristic engine according to claim 4, wherein the actuator is disposed at an axial one end of the crankshaft and on a front end side of the engine block, and wherein a switch valve for supplying the working oil from the hydraulic pressure supply device to the actuator is disposed on a front surface of the engine block and at an end of the engine block closer to the actuator.

6. The variable stroke-characteristic engine according to claim 4, wherein the actuator is disposed at a portion of the engine block on the front side of the vehicle body, and wherein a portion of the engine block closer to a cylinder head is inclined rearward of the vehicle body.

* * * * *